US006385807B1

(12) United States Patent
Pinochi

(10) Patent No.: US 6,385,807 B1
(45) Date of Patent: May 14, 2002

(54) TOOL FOR WASHING FLOORS

(75) Inventor: Franco Pinochi, Monsummano Terme (IT)

(73) Assignee: Tuttoscope S. Fransesco S.r.l., Pistoia (IT)

( * ) Notice: Subject to any disclaimer, the term of this patent is extended or adjusted under 35 U.S.C. 154(b) by 7 days.

(21) Appl. No.: 09/714,118

(22) Filed: Nov. 17, 2000

(30) Foreign Application Priority Data

Dec. 24, 1999 (IT) ..... MO99A0285

(51) Int. Cl.[7] ..... A47L 13/146
(52) U.S. Cl. ..... 15/119.2; 15/121
(58) Field of Search ..... 15/116.1, 116.2, 15/119.1, 119.2, 121

(56) References Cited

U.S. PATENT DOCUMENTS 2,251,384 A * 8/1941 Thomas
2,653,336 A * 9/1953 Berndsen
2,715,743 A * 8/1955 Ljungdahl
2,750,613 A * 6/1956 Trindl
2,794,997 A * 6/1957 Channell
2,887,704 A * 5/1959 Vosbikian et al.
2,994,097 A * 8/1961 Fungaroli
3,023,438 A * 3/1962 Trentel
3,271,804 A * 9/1966 Tillinghast
6,003,187 A * 12/1999 Footer et al.

FOREIGN PATENT DOCUMENTS

WO WO 96/33649 * 10/1996

* cited by examiner

*Primary Examiner*—Terrence R. Till
(74) *Attorney, Agent, or Firm*—Browdy and Neimark

(57) ABSTRACT

A tool for washing floors, having at a lower end of a handle a sponge-bearing device comprising at least a first segment and at least a second segment, both first and second segments together forming a support for a sponge, both first and second segments being preferably flat and elongate in shape and hinged together in order to be able to pass from an extended work configuration into a bunched squeezing configuration. The first segment is constrained to the lower end of the handle, while the second segment is constrained to an end of a con rod having another end which is hinged to a sliding sleeve coaxially coupled on the handle. The lower end of the handle is hinged to the first segment about an axis contained in a perpendicular plane to the first segment. The lower end of the con rod is constrained to the second segment by means of an element which is hinged to the second segment in such a way as to be freely rotatable about an axis which is coplanar with the axis hinging the first segment to the handle.

6 Claims, 2 Drawing Sheets

Fig. 3
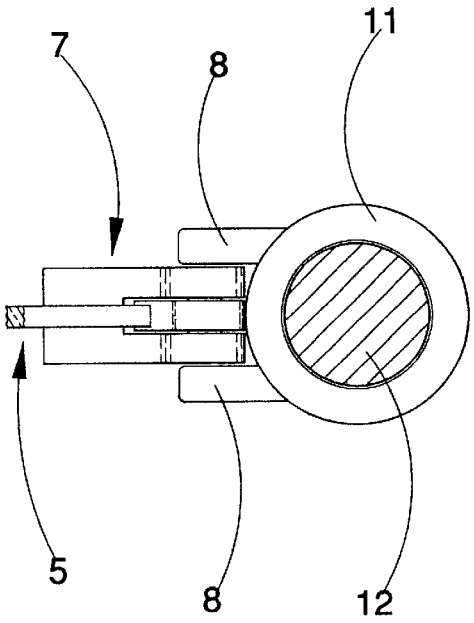
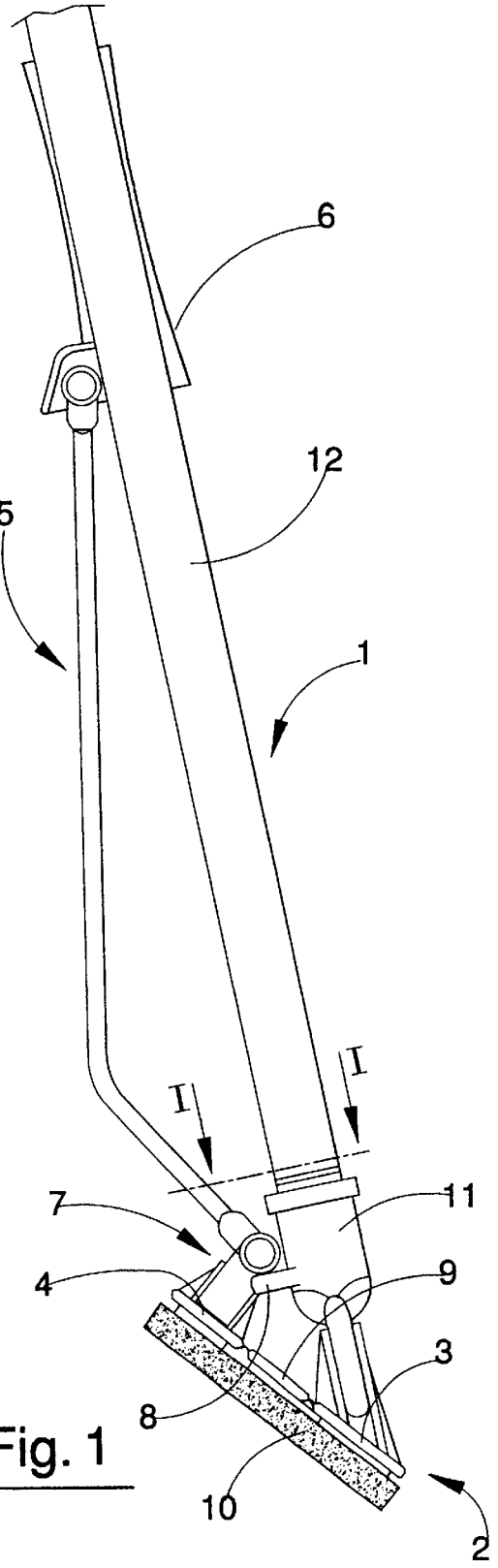
Fig. 1

TOOL FOR WASHING FLOORS

BACKGROUND OF THE INVENTION

The tool is of a type having a handle with, at an end thereof, a sponge-bearing device (a sponge being used for washing the floor). This device comprises at least a first segment and at least a second segment, which together form a support for the sponge; both segments are preferably flat and elongate, and are hinged one to the other in order to be able to pass from an extended working configuration into a folded configuration, in which the sponge can be squeezed.

The passage from one configuration to the other is achieved very simply, by manually pushing a sleeve which, running along the handle and being connected to a rod which in turn is connected to the second of the segments, produces a rotation of the second segment relative to the first segment which thus leads to a compressing and therefore a squeezing of the sponge.

In these realizations, the lower end of the handle is stably fixed to the first segment of the device, while the second segment is constrained by a simple hinge to an end of the manoveuvring rod, which rod has another end hinged to the manoeuvring sleeve which is slidably and coaxially coupled to the handle. In prior-art applications, the stable fixture of the handle to the first segment of the sponge-bearing device constitutes a rigid coupling which very severely limits freedom of movement of the tool during operation. It is also true, however, that the structure of the mechanism for squeezing the sponge in these applications requires a rigid coupling between the handle and the first segment of the sponge-bearing device.

SUMMARY OF THE INVENTION

The main aim of the present invention is to obviate the above-mentioned limitations in the prior art by providing a tool which, while keeping the basic mechanism for sponge-squeezing intact, also affords a freedom of rotation for the handle in relation to the sponge-bearing device.

The invention has the advantages of being of simple construction while also being very functional.

These aims and advantages and others besides are all attained by the present invention, as it is characterised in the appended claims.

BRIEF DESCRIPTION OF THE DRAWINGS

Further characteristics and advantages of the invention will better emerge from the detailed description that follows of a preferred but non-exclusive embodiment thereof, illustrated purely by way of non-limiting example in the accompanying figures of the drawings, in which:

FIG. 1 shows a schematic front view in vertical elevation;

FIG. 3 shows, in enlarged scale, a section made according to line I—I of FIG. 1;

DESCRIPTION OF THE PREFERRED EMBODIMENTS

Figure 2:
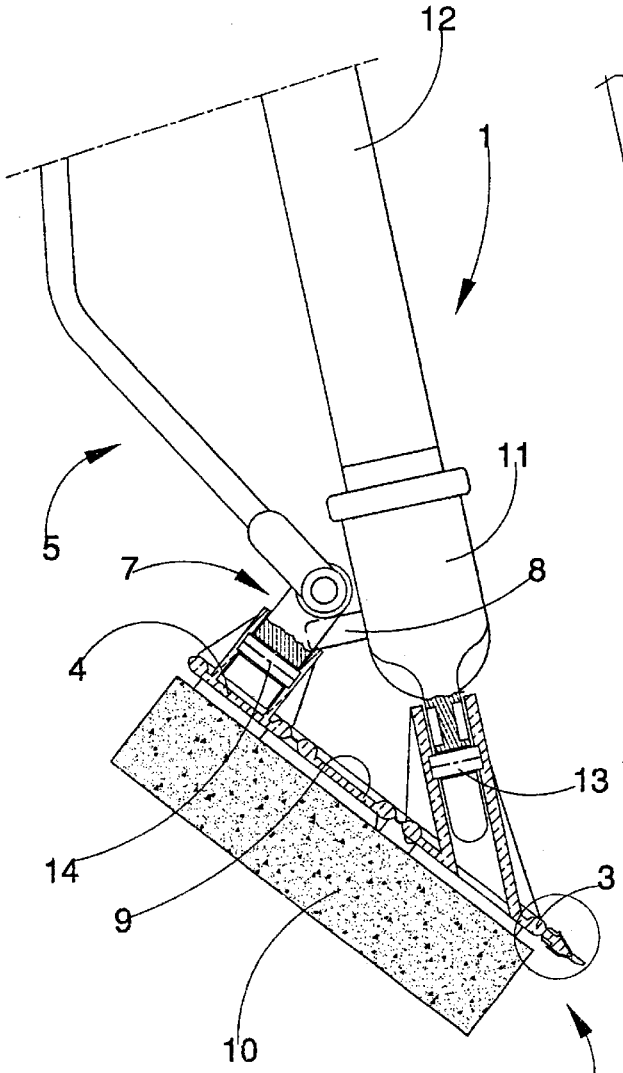
FIGS. 2 and 2A show a partial section and an enlarged scale of a scale of a part of FIG. 1.
Figure 2A:
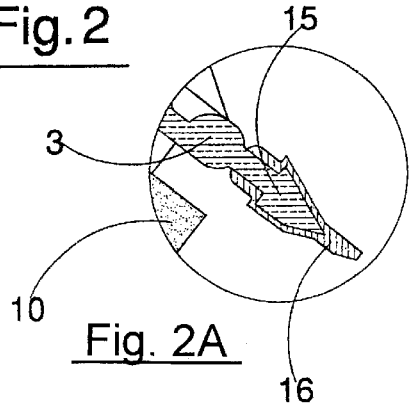
Figure 4:
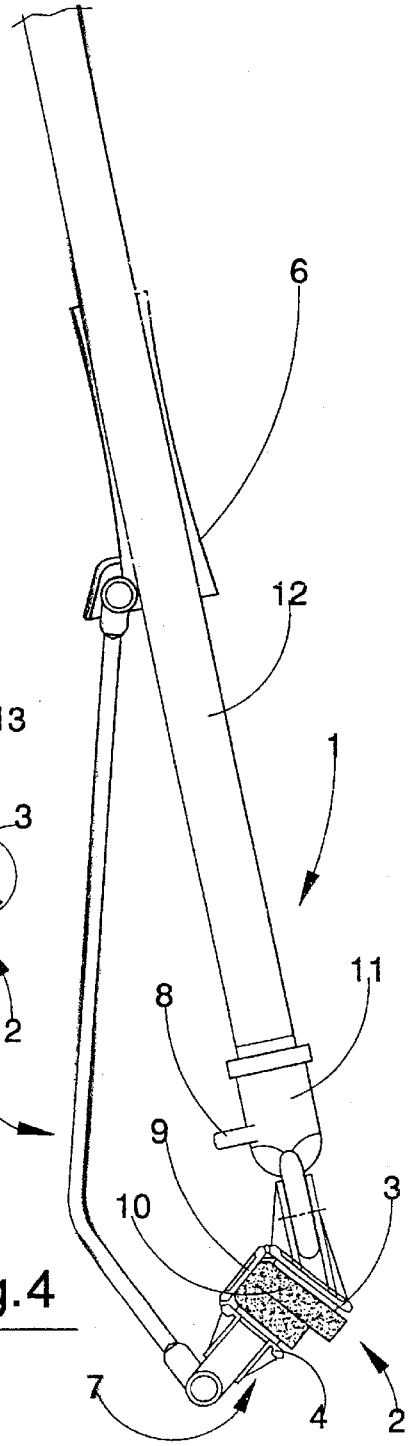
FIG. 4 shows the same view as FIG. 1 in a different operative configuration.

In the above-mentioned figures of the drawings, a floor-washing tool is illustrated, of a type bearing, at a lower end of a handle 1, a sponge-bearing device including at least a first segment 3 and at least a second segment 4, both of which function as a support for a sponge 10.

In the illustrated embodiment, an intermediate segment 9 is interpositioned between the first segment 3 and the second segment 4, both the first segment 3 and the second segment 4 being hinged to the intermediate segment 9 about two parallel axes.

The first segment 3, the intermediate segment 9 and the second segment 4 are flat and elongate and are consecutively hinged in order to be able to pass from an extended work position to a bunched sponge-squeezing position.

The first segment 3 is constrained to a lower end of the handle 1 by means of a screw-joint 11 by which it can be screwed to a rod 12, which rod 12, together with the joint 11, form the handle 1.

The second segment 4 is constrained to an end of a con rod 5 which has another end hinged to a mobile sleeve 6 coaxially coupled to the handle 1. By sliding the sleeve 6 a user can command a rotation of the second segment 4 and the intermediate segment 9 with respect to the first segment 3.

The lower end of the handle 1, i.e. the joint 11 end, is hinged, by means of a pivot 13, to the first segment 3 about an axis contained in a plane which is perpendicular to the first segment 3.

The lower end of the con rod 5 is constrained to the second segment by means of a element 7 which is in turn hinged by means of a pivot 14 to the second segment 4, and can rotate freely about at least about an axis which is coplanar with the hinge axis of the handle 1 and the first segment 3.

The hinge axis of the handle 1 and the first segment 3 is perpendicular to the axis of the handle 1.

Guide elements are provided to constrain the element 7 solidly to the handle for the rotations of the handle 1 about the axis by which it is hinged to the first segment 3 at least in the extended work configuration. The guide elements hold the element 7 laterally and comprise for this purpose two projections 8, fixed to the lower end of the handle 1, i.e. the joint 11, and symmetrically arranged with respect to a median plane of the handle 1 which plane contains the axis by which the handle 1 is hinged to the first segment 3.

In this way, in the work configuration with the sponge 10 extended, the segments 3, 9 and 4 are aligned on a same plane and the element 7 is prevented from rotating about the pivot 13, by which it is hinged to the second segment 4, by the action of the two projections 8. This also enables the handle 1 to rotate freely about the axis by which it is hinged to the first segment 3, drawing with it the element 7 and the rod 5, without the rotation having a significant influence on the second element 4.

On the opposite side to the side by which it is hinged to the intermediate segment 9, the first segment 3 bears an appendix 15 for enabling a joint with a floor wiper 16 and/or window wiper.

The addition of the wiper 16 enables the tool to be used not only for sponging but also for scraping or wiping a floor or window.

The special structure of the tool, which renders the handle 1 mobile with respect to the sponge-bearing device 2, enables the tool to reach otherwise inaccessible places easily—i.e. places which a traditional tool cannot reach since the connection between the handle and the sponge-bearing device is fixed.

What is claimed is:

1. A tool for washing floors, having at a lower end of a handle a sponge-bearing device comprising at least two segments, a first segment and a second segment, both the first and second segments together forming a support for a sponge, both first and second segments being preferably flat and elongate in shape and hinged together in order to be able to pass from an extended work configuration into a bunched squeezing configuration, the first segment being constrained to the lower end of the handle, the second segment being constrained to an end of a con rod having another end which is hinged to a sliding sleeve coaxially coupled on the handle, wherein the lower end of the handle is hinged to the first segment about an axis contained in a perpendicular plane to the first segment and wherein the lower end of the con rod is constrained to the second segment by means of an element which is hinged to the second segment in such a way as to be freely rotatable about an axis which is coplanar with the axis hinging the first segment to the handle.

2. The tool for washing floors of claim 1, wherein the axis hinging the handle to the first segment is perpendicular to the axis of the handle.

3. The tool for washing floors of claim 1, wherein it comprises guide elements for constraining the element solidly to the handle when the handle is rotated about the axis hinging the handle to the first segment at least when the tool is in the work configuration.

4. The tool for washing floors of claim 3, wherein the guide elements comprise two projections fixed to the lower end of the handle and arranged symmetrically with respect to a median plane of the handle which median plane contains the axis by which the handle is hinged to the first segment.

5. The tool of claim 4, wherein an intermediate segment is interpositioned between the first segment and the second segment and hinged to the first segment about an axis and to the second segment about an axis, which axes are parallel one to another.

6. The tool of claim 5, wherein the first segment, on a side thereof opposite to a side whereby it is hinged to the intermediate segment, exhibits an appendix for enabling a joint-fitting of a floor-wiper.

* * * * *